US009925659B1

(12) United States Patent
Clemmer

(10) Patent No.: US 9,925,659 B1
(45) Date of Patent: Mar. 27, 2018

(54) MECHANIC'S CREEPER AND HEADREST

(71) Applicant: David L. Clemmer, Sebastopol, CA (US)

(72) Inventor: David L. Clemmer, Sebastopol, CA (US)

( * ) Notice: Subject to any disclaimer, the term of this patent is extended or adjusted under 35 U.S.C. 154(b) by 0 days.

(21) Appl. No.: 14/789,238

(22) Filed: Jul. 1, 2015

Related U.S. Application Data

(60) Provisional application No. 62/019,743, filed on Jul. 1, 2014.

(51) Int. Cl.
*B25H 5/00* (2006.01)

(52) U.S. Cl.
CPC ..... *B25H 5/00* (2013.01)

(58) Field of Classification Search
CPC ..... B25H 5/00; B25H 1/04
See application file for complete search history.

(56) References Cited

U.S. PATENT DOCUMENTS 1,581,592 A * 4/1926 Neal ..... B25H 5/00 280/32.6
2,650,372 A * 9/1953 Lowe ..... B25H 5/00 280/32.6
2,942,693 A * 6/1960 Johnson ..... B25H 5/00 188/5
4,993,522 A * 2/1991 Wagner ..... F16F 9/0272 188/269
5,829,077 A * 11/1998 Neige ..... A47C 20/041 5/616
6,042,145 A * 3/2000 Mitschelen ..... B60N 2/0232 280/735
7,331,557 B2 * 2/2008 Dewert ..... A47C 20/041 248/419
7,963,598 B2 * 6/2011 Akaike ..... B60N 2/002 297/216.12
8,336,142 B1 * 12/2012 See ..... A61G 13/1215 5/633
9,126,326 B1 * 9/2015 Bowen ..... B25H 5/00
2003/0168824 A1 * 9/2003 Miles ..... B25H 5/00 280/32.6
2006/0186619 A1 * 8/2006 Sieb ..... B25H 5/00 280/32.6
2006/0250016 A1 * 11/2006 Wang ..... B60N 2/002 297/408
2007/0013154 A1 * 1/2007 Staples ..... B25H 5/00 280/32.6
2007/0194878 A1 * 8/2007 Touge ..... G01S 7/282 340/5.2

(Continued)

*Primary Examiner* — Hau V Phan
(74) *Attorney, Agent, or Firm* — Larry D. Johnson

(57) ABSTRACT

A mechanic's creeper and headrest apparatus includes a frame, a plurality of wheels or casters, a back support, and a movable headrest, and includes an electric motor-driven mechanism such as a linear actuator, cylinder, ram, rack, screw, gear, or other mechanism operable to raise and lower the headrest to a desired tilt or height. The electric motor-driven mechanism is preferably connected to a rocker switch mounted on the frame such that the user can selectively raise and lower the headrest with one hand by manipulation of the rocker switch. The frame also preferably includes a power switch and a battery to provide power to the electric motor drive mechanism.

9 Claims, 3 Drawing Sheets

(56) References Cited

U.S. PATENT DOCUMENTS

| | | | | |
|---|---|---|---|---|
| 2007/0235960 | A1* | 10/2007 | Pantaleoni | B25H 5/00 280/32.6 |
| 2007/0257528 | A1* | 11/2007 | Akaike | B60N 2/002 297/216.12 |
| 2009/0062989 | A1* | 3/2009 | Sakai | B60N 2/002 701/45 |
| 2011/0227303 | A1* | 9/2011 | Gering | B25H 1/04 280/32.6 |
| 2012/0212353 | A1* | 8/2012 | Fung | B60K 28/06 340/905 |
| 2013/0113250 | A1* | 5/2013 | Udriste | B64D 11/06 297/217.3 |

* cited by examiner

MECHANIC'S CREEPER AND HEADREST

CROSS REFERENCE TO RELATED APPLICATIONS

The present application claims the benefit of the filing date of U.S. Provisional Patent Application Ser. No. 62/019,743, filed Jul. 1, 2014. The foregoing application is incorporated by reference in its entirety as if fully set forth herein.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to mechanic's creepers, and more particularly to an improved mechanic's creeper and headrest apparatus.

BACKGROUND INFORMATION AND DISCUSSION OF RELATED ART

Many current creepers for use primarily by mechanics and others include a frame of longitudinally extending metal rails which carry four or more casters and which have metal cross members extending between them. A flat pad is positioned on the cross members to support the user. At times, a thickened area of the pad is provided at one end of the pad which is intended to be a headrest for the user. However, these types of creepers have often proven to be uncomfortable to the user.

The foregoing information reflects the current state of the art of which the present inventor is aware. Reference to, and discussion of, this information is intended to aid in discharging Applicant's acknowledged duty of candor in disclosing information that may be relevant to the examination of claims to the present invention. However, it is respectfully submitted that none of the above-indicated information discloses, teaches, suggests, shows, or otherwise renders obvious, either singly or when considered in combination, the invention described and claimed herein.

SUMMARY OF THE INVENTION

The present invention provides an improved mechanic's creeper and headrest apparatus. The inventive mechanic's creeper includes a frame, a plurality of wheels or casters, a back support, and a movable headrest, and includes an electric motor-driven mechanism such as a linear actuator, cylinder, ram, rack, screw, gear, or other mechanism operable to raise and lower the headrest to a desired tilt or height. The electric motor-driven mechanism is preferably connected to a rocker switch mounted on the frame such that the user can selectively raise and lower the headrest with one hand by manipulation of the rocker switch. The frame also preferably includes a power switch and a battery to provide power to the electric motor drive mechanism.

It is therefore an object of the present invention to provide a new and improved mechanic's creeper and headrest.

It is another object of the present invention to provide a new and improved mechanic's creeper with a headrest that can be raised and lowered automatically.

A further object or feature of the present invention is a new and improved mechanic's creeper with a headrest that can be easily raised and lowered by the user with only one hand.

An even further object of the present invention is to provide a novel electronically controlled headrest riser for mechanic's creepers.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
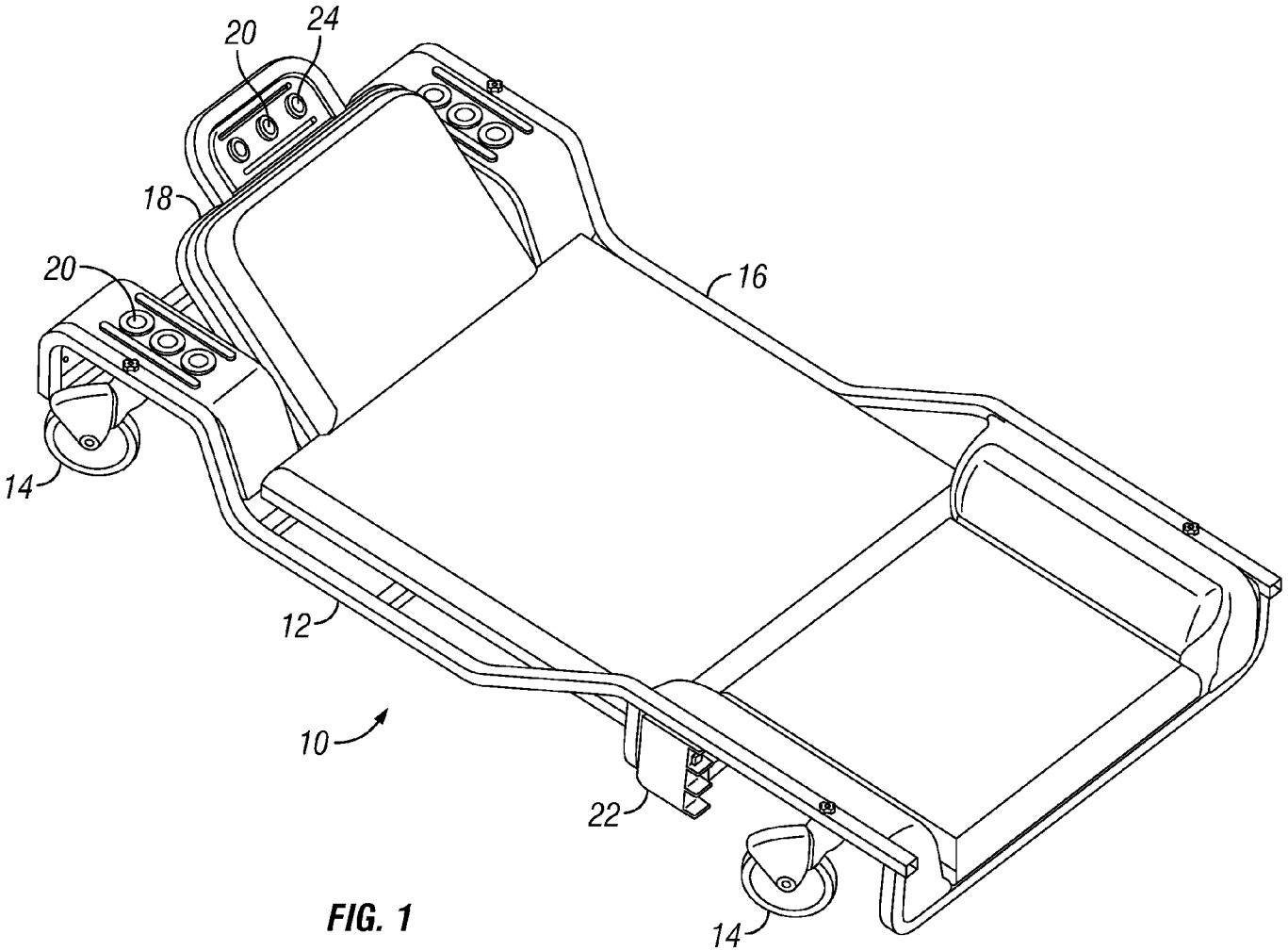
FIG. 1 is a perspective view of an improved mechanic's creeper and headrest of this invention.

Referring to FIGS. 1 through 4, wherein like reference numerals refer to like components in the various views, there is illustrated therein a new and improved mechanic's creeper and headrest, generally denominated 10 herein.

FIG. 1 is a perspective view of a mechanic's creeper 10 having a frame 12 (e.g., 46 inch overall length), a plurality of wheels (e.g., 4 inch casters) 14, a back support 16, and a movable headrest 18 (e.g., 0-40° headrest tilt). Optional LED task lights 20 may be used to illuminate the work area and may be activated by light switches 22 mounted on the frame for easy access to the user. Separately controlled LED lights allow for switching of lights when desired (to avoid glare when facing individual lighting unit). Height or proximity sensors 24 may be mounted on the moveable headrest to prevent movement of the headrest beyond a point a safe distance away from an obstacle to protect the user's head from injury. Fenders keep the user's body, hair and clothes out of the caster wheels. The frame may also include one or more tray assemblies for storage, drink holders, and a USB port for electronics.

Figure 2:
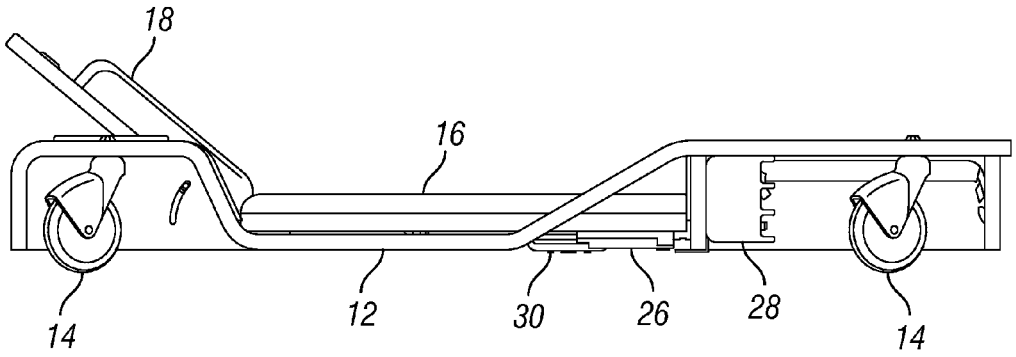
FIG. 2 is a right side view of a linear actuator driven embodiment for the moveable headrest.

FIG. 2 is a right side view of a mechanic's creeper illustrating an electric drive mechanism in the form of a linear actuator 26 to drive the moveable headrest 18. Linear actuator 26 is mounted to frame below the back support 16, and is mechanically linked to the headrest 18. Overload protection in the linear actuator in the form of a preloaded spring (e.g., compressing the spring half way, or approximately 40 pounds of load) prevents damage to unit or injury to user. Motor control switch 28 (such as an up/down rocker switch or one or more momentary switches) controls the linear actuator and the position of the headrest, and is mounted to the frame in easy reach of the user (may be co-located with light switches 22 or located elsewhere), such that the user can selectively raise and lower the headrest with one hand by manipulation of the rocker switch. Removable and rechargeable battery pack 30 is mounted to the frame below the back support, and powers the linear actuator, lights, sensors, and other components. Alternatively, a patch cord may be used to recharge the batteries.

Figure 3:
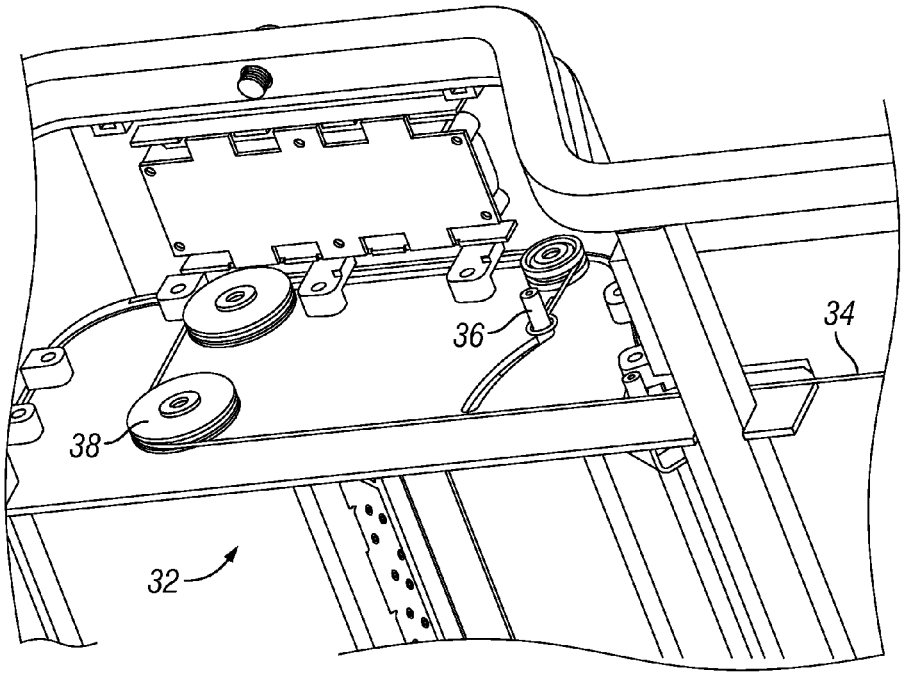
FIG. 3 is a view of a cable lift mechanism used with the linear actuator.

FIG. 3 is a view of a cable lift mechanism 32 that may be used to link the linear actuator to the moveable headrest, which may include a cable 34 linked over a headrest support strut 36 by a plurality of pulleys 38. This arrangement has been found to provide a good mechanical advantage, while minimizing height.

Figure 4:
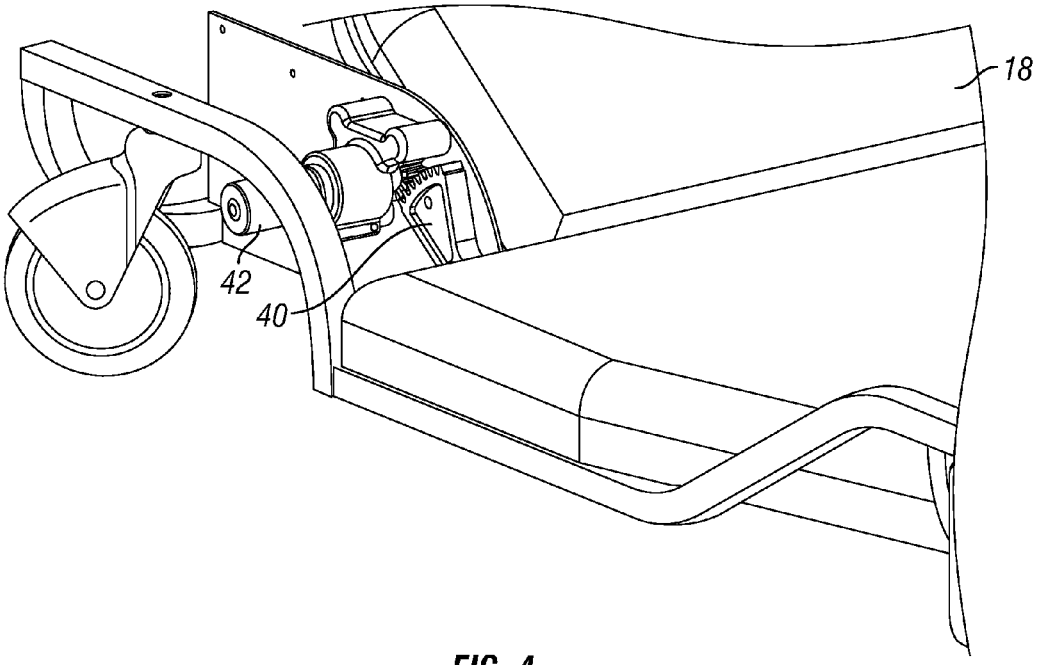
FIG. 4 is a view of an alternate gear-driven embodiment for the moveable headrest.

FIG. 4 is a view of an alternate gear-driven embodiment for the moveable headrest. Gear 40 is driven by motor 42, and is linked directly to the moveable headrest 18.

A non-electric embodiment for a moveable headrest may be in the form of a spring actuated headrest such as a torsion spring strong enough to lift the headrest, but not the head of the user. A cable-actuated locking pin mechanism slides through holes in a single side plate. A retract mechanism uses a compression spring to drive the pin into a hole in the side plate, and a brake cable from a hand-actuated brake release retracts the pin from the hole, so that the user can manually select the desired position for the headrest.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A mechanic's creeper and headrest apparatus comprising:

a frame;

a plurality of casters connected to said frame;

a back support and a movable headrest connected to said frame;

an electric motor-driven mechanism operable to raise and lower said headrest relative to said back support and said frame; and a proximity sensor mounted on said headrest to detect proximity of an obstacle and prevent movement of said headrest beyond a point a safe distance away from the obstacle to protect the user's head from injury.

2. The mechanic's creeper and headrest apparatus of claim 1 wherein said electric motor-driven mechanism is connected to a rocker switch mounted on said frame such that the user can selectively raise and lower the headrest with one hand by manipulation of said rocker switch.

3. The mechanic's creeper and headrest apparatus of claim 1 wherein said frame includes a battery to provide power to said electric motor-driven mechanism.

4. The mechanic's creeper and headrest apparatus of claim 3 wherein said battery is removable and rechargeable.

5. The mechanic's creeper and headrest apparatus of claim 1 wherein said electric motor-driven mechanism comprises a linear actuator.

6. The mechanic's creeper and headrest apparatus of claim 5 wherein said linear actuator includes a cable connected to a headrest support strut.

7. The mechanic's creeper and headrest apparatus of claim 1 wherein said electric motor-driven mechanism comprises a gear connected to said headrest.

8. The mechanic's creeper and headrest apparatus of claim 1 wherein said frame includes LED task lights.

9. The mechanic's creeper and headrest apparatus of claim 8 wherein said LED task lights are activated by light switches mounted on said frame for easy access to the user.

* * * * *